US005188235A

United States Patent [19]

Pierce et al.

[11] Patent Number: 5,188,235

[45] Date of Patent: Feb. 23, 1993

[54] BAG PACK

[75] Inventors: Larry W. Pierce, Spring; Steve F. Zeigler, Dallas; Jacobo Bazbaz, Houston, all of Tex.

[73] Assignee: Superbag Corp., Houston, Tex.

[21] Appl. No.: 662,453

[22] Filed: Feb. 28, 1991

[51] Int. Cl.[5] ..... B65D 33/14

[52] U.S. Cl. ..... 206/554; 383/8; 383/9

[58] Field of Search ..... 206/449, 495, 554, 806; 383/8, 9, 37, 903

[56] References Cited

U.S. PATENT DOCUMENTS

| | | | |
|---|---|---|---|
| Re. 33,264 | 7/1990 | Baxley et al. | 206/554 |
| 3,348,760 | 10/1967 | Hinsken et al. | 383/9 |
| 4,537,310 | 8/1985 | Thul | 206/806 |
| 4,560,067 | 12/1985 | Reimann | 206/554 |
| 4,562,925 | 1/1986 | Pistner | 383/8 |
| 4,676,378 | 6/1987 | Baxley | 206/554 |
| 4,785,938 | 11/1988 | Benoit, Jr. et al. | 206/554 |
| 4,796,759 | 1/1989 | Schisler | 206/554 |
| 4,811,417 | 3/1989 | Prince et al. | 206/554 |
| 4,883,450 | 11/1989 | Benoit | 383/9 |
| 4,981,216 | 1/1991 | Wilfong, Jr. | 383/8 |
| 4,989,732 | 2/1991 | Smith | 206/554 |
| 4,995,860 | 2/1991 | Wilfong, Jr. | 206/554 |
| 5,074,674 | 12/1991 | Kuklies et al. | 206/554 |

FOREIGN PATENT DOCUMENTS

| | | | |
|---|---|---|---|
| 3831823 | 3/1990 | Fed. Rep. of Germany | 206/554 |

*Primary Examiner*—David T. Fidei
*Attorney, Agent, or Firm*—Vinson & Elkins

[57] ABSTRACT

A bag pack is disclosed formed of multiple stacked handle bags having aligned mounting apertures defined through the handle portions of the bags for reception of mounting rods therethrough. The mounting apertures are formed as elongated, generally vertically extending, slots having curved upper and lower portions. Elongated mounting slots make possible the use of shorter handles for the bags without sacrificing either the size of the mouth opening during loading or the carrying capacity of the bags. A central mounting tab on the multiple stacked bags has a vertical perforation extending between a generally horizontal central mounting aperture and the bag mouth, thus permitting the bag to be removed from a cooperating bag rack without leaving any portion of the central mounting tab on the bag rack.

19 Claims, 3 Drawing Sheets

BAG PACK

TECHNICAL FIELD OF THE INVENTION

This invention relates to thermoplastic shopping bags of the type used at grocery store checkout counters. More particularly, it relates to such bags inter-related in a manner which enables the simultaneous mounting of multiple bags, as a unit or bag pack, on a mounting rack within the bags, in turn, being individually opened and loaded while on the rack and subsequently removed therefrom.

BACKGROUND OF THE INVENTION

Bags of the general type involved herein are frequently formed from flattened tube portions selectively severed from a length of tubing of appropriate material and subsequently heat sealed along the lower and upper edges thereof. An appropriate mounth-defining U-shaped cutout is normally made through the sealed upper edge, this cutout simultaneously defining both the upper mouth of the bag and a pair of laterally spaced handles. Such bags can be formed with or without side gussets.

It has become increasingly common to provide such bags in packs for suspension on racks with the individual bags separately dispensed therefrom. For such purpose, mounting apertures are formed in the handle portions of such bags as shown, for example, in U.S. Pat. No. 4,676,378 and U.S. Pat. No. Re. 33,264. In such prior art bags the mounting aperatures are formed as small round holes having a diameter not sustantially larger than that of the mounting rods of the cooperating racks. When such bags are disposed in a mouth open position on the rods of the mounting rack (see, for example, FIGS. 2 and 10 of U.S. Pat. No. 4,676,378), the mounting apertures of the front and rear handles of the bag are displaced from each other as far as possible, with the length of displacement being limited by the maximum opening width of the bag and the length of the joined handle portions of the bags above the mounting apertures. This requires that the prior art bags have relatively elongated handle portions above the mounting apertures since, otherwise, it would not be possible to open the bag mouth to the extent required for filling.

SUMMARY OF THE INVENTION

It is, accordingly, a principal object of the present invention to provide an improved bag construction in which elongated mounting apertures in the form of substantially vertical slots with rounded end portions are provided in the handle portions of the bags so that the mounting apertures may be formed much nearer the top of the handle portions while still permitting maximum opening of the bag mouths on the dispensing racks. The improved construction according to the present invention makes possible use of shorter bag handles, and resultant savings of material costs, without sacrificing ease of use of the bags. The improved construction also makes bag packs in accordance with the present invention more versatile in that they can be used with bag dispensing racks of various types and various support arm configurations, whereas prior art bag packs generally were designed for use with specific support racks of the same manufacturer.

A further object and advantage of the present invention is to provide an improved bag pack which is more easily dispensed from the support/dispensing rack and which leaves no detachable tab or other portion of the bag on the rack after dispensing.

Additional objects and advantages of the present invention will be apparent from the following specification and claims and from the appended drawings in which like numerals indicate like parts and in which:

DESCRIPTION OF THE PREFERRED EMBODIMENTS

Figure 1:
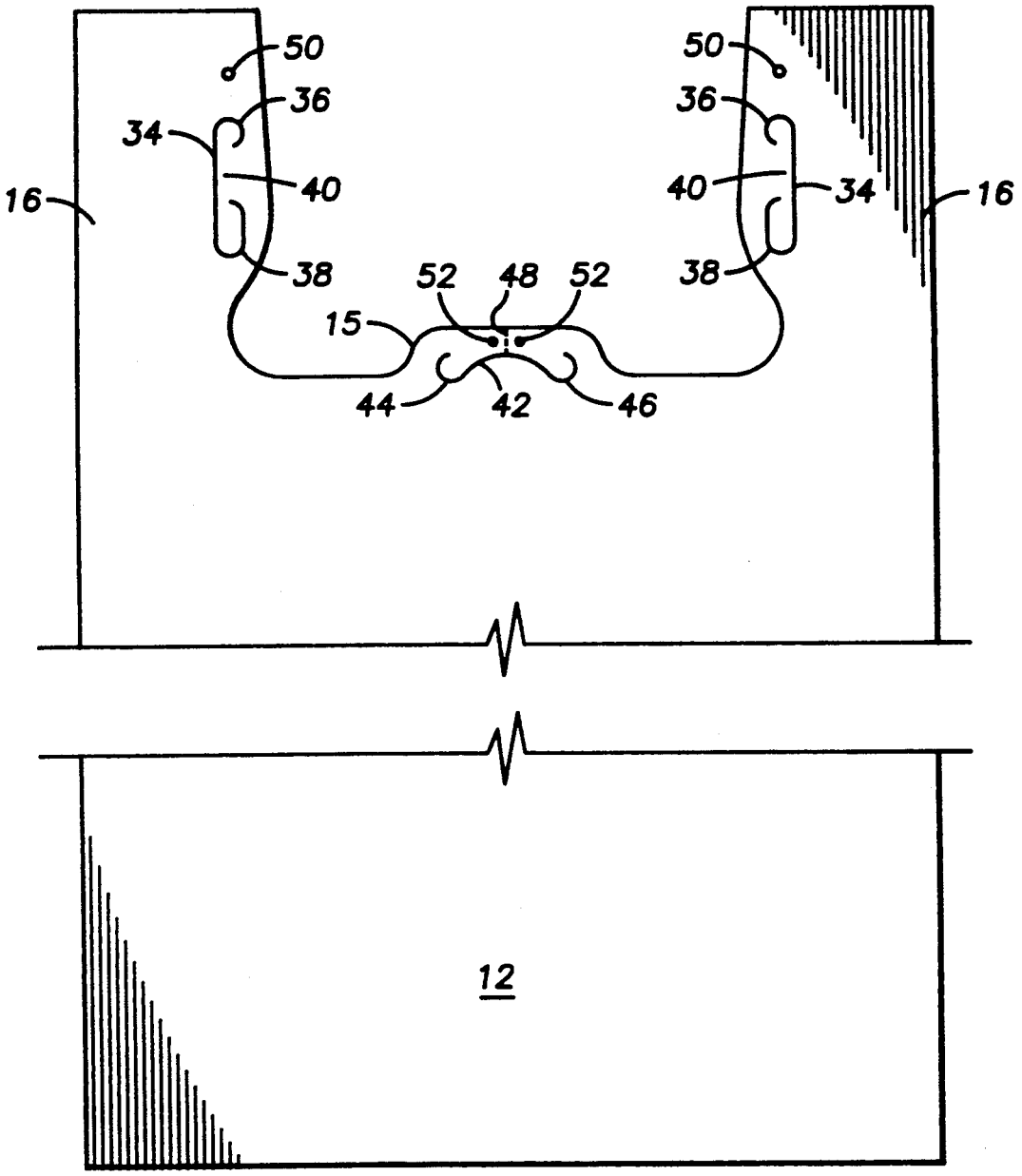
FIG. 1 is a view in front elevation of a bag pack formed in accordance with the present invention.

Referring now more specifically to the drawings, reference numeral 10 designates a bag pack formed, in accordance with the present invention, of multiple individual bags 12.

The bags 12 are preferably of a lightweight, highly flexible and strong thermoplastic materials, and are conventionally fabricated from a continuous plastic tube gusseted, flattened and heat sealed at opposed upper and lower ends. The mouth 14 of the bag 12 is formed by a cutout inwardly and centrally through the upper portion of the bag. This cutout defines front and rear central mounting tabs 15 and a pair of laterally spaced upwardly extending handles 16 formed of upwardly extending portions of the front and rear panels 18 and 20 of the bag 12 respectively as well as similarly upwardly extending portions of the side gussets 22. The lower portions of the bag handles define the lateral extent of the bag mouth and upper portions of the bag handles define a hand grip for the bags. Such bag construction, as thus far described, is generally known in the art as will be appreciated from U.S. Pat. No. 4,529,090.

It is a principal purpose of the invention to provide for the mounting of a pack 10 of the bags 12 on a support rack 24 for both the selective dispensing of the individual bags by the handles and with the open mouth upwardly directed for a loading of the bag. The rack 24 will basically consist of a flat base or support panel 26 and a pair of laterally spaced supported arms 28 positioned vertically above the base panel 26 a distance sufficient to acccommodate a fully expanded bag with the handles 16 engaged with the support arms 28 and the bottom of the bag on the panel 26. A transverse member 29, extending between the support arms 28, supports a tab receiving hook element 30 for engagement through apertures formed in or below the tab portions 15 of the bags, as described below. The support arms 28 and transverse member 29 may be rigidly joined to a vertical member 31 which in turn has its lower end appropriately rigidly affixed to the panel 26 toward the rear thereof. The bag pack 10 will normally be accommodated generally rearward on the rack 24 toward the upright, or vertical member, allowing for the forward extent of the support panel 26 and overlying support rods 28 to accommodate an opened bag for loading purposes. The rack 24 will also normally include upturned forward ends 32 on the laterally spaced horizontal support rods 28, for preventing accidental forward displacement of the bag handles off of the forward ends of the support rods.

Figure 3:
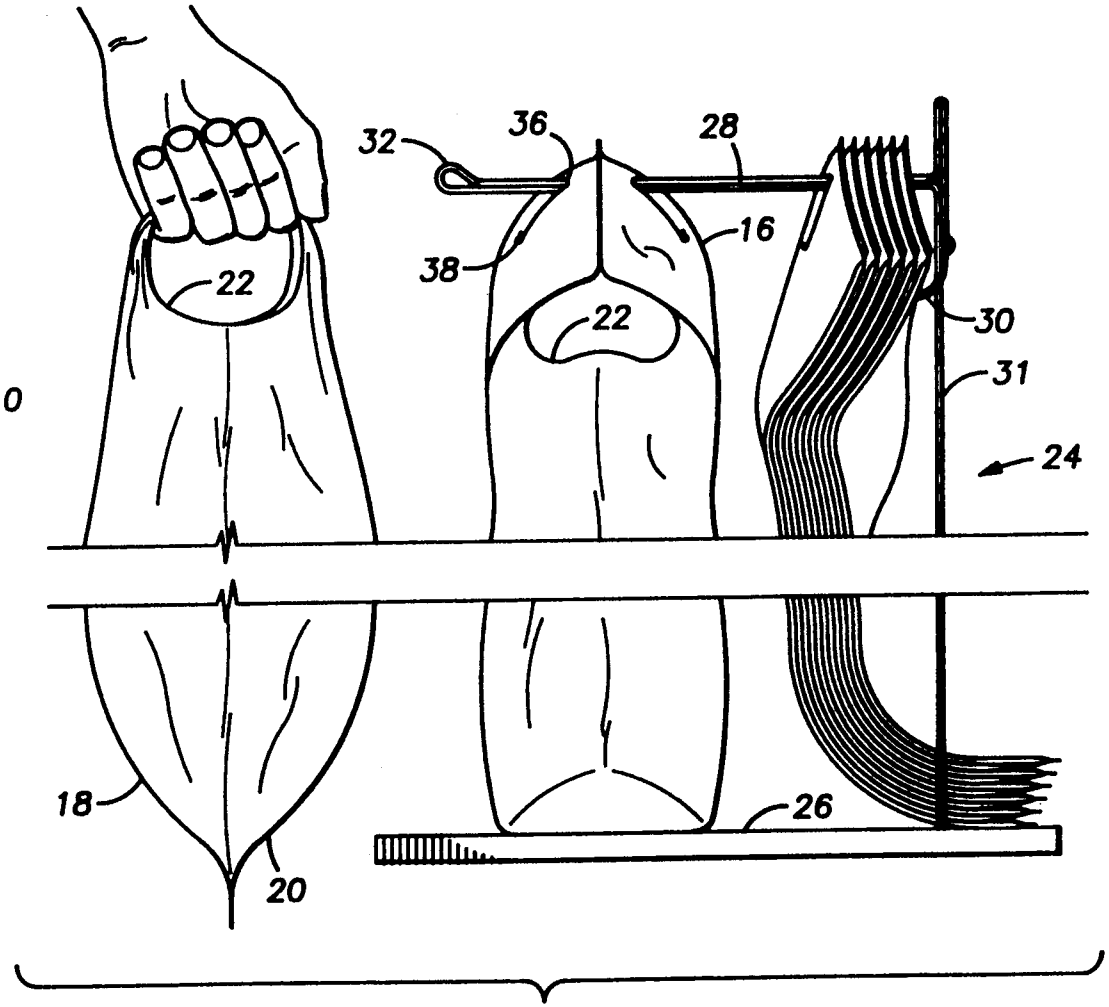
FIG. 3 is a partial perspective view illustrating a bag pack in accordance with the present invention mounted on a rack with the bag handles engaged with a pair of mounting rods.
Figure 2:
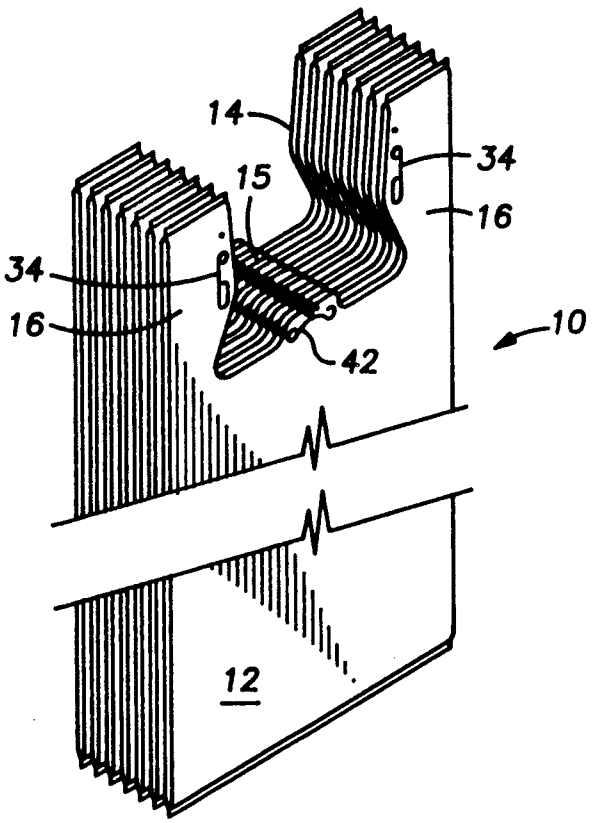
FIG. 2 is a partial perspective view of the bag pack of FIG. 1.
Figure 4:
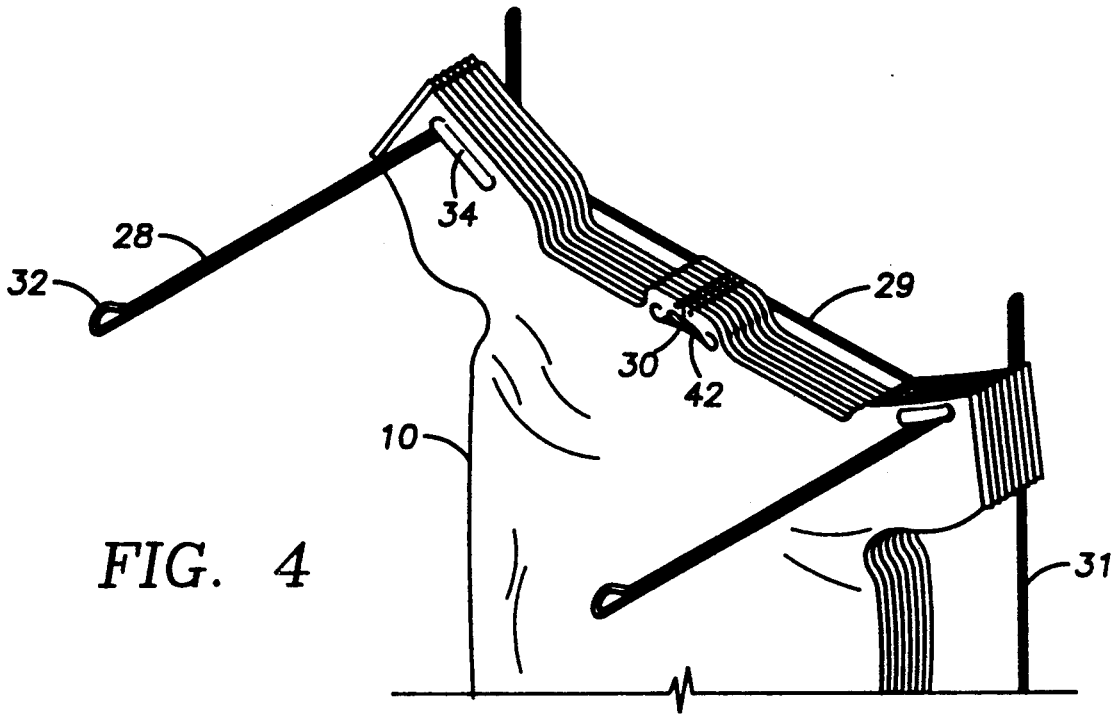
FIG. 4 is a partial perspective view from a different angle of the bag pack and rack of FIG. 3.
Figure 5:
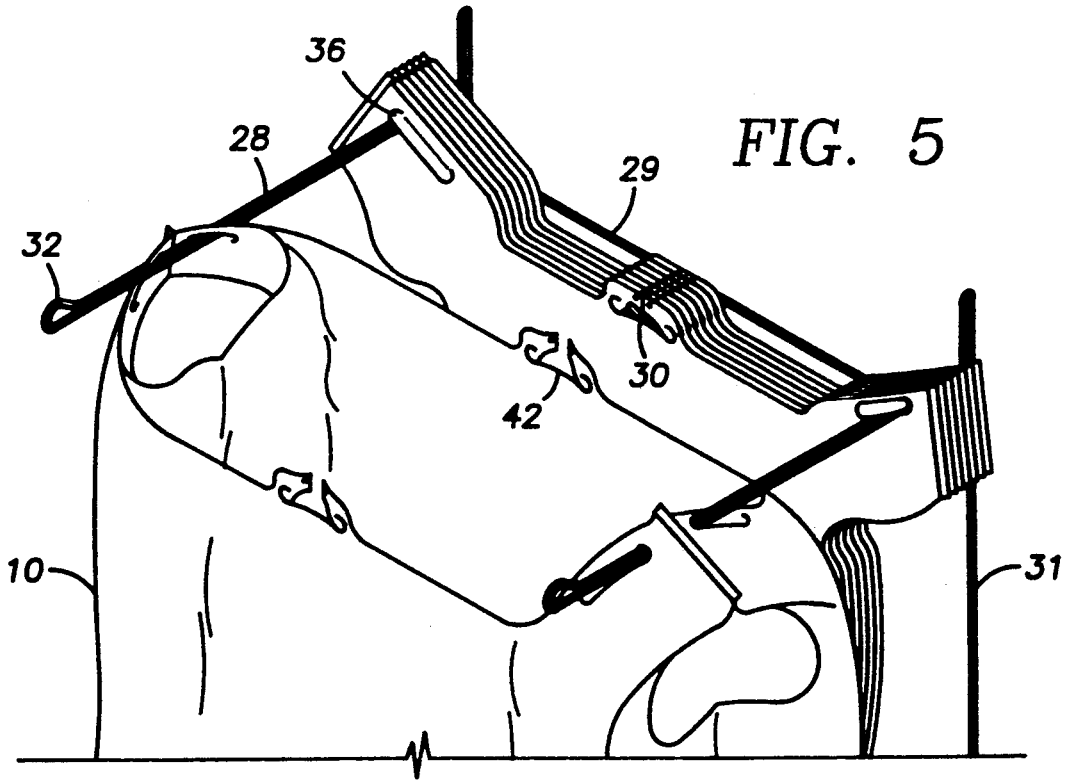
FIG. 5 is a partial perspective view illustrating a bag drawn forwardly from the bag pack and maintained on the support rods in its mouth open loading position.

As will be appreciated from FIGS. 2 through 4, it is specifically intended that the bag pack 10 be suspended from the support rods 28 by handles 16 and from the central mounting tabs 15 by the hook 30 in a manner whereby each individual bag 12, as it is moved forward from the pack 10, is retained in an upright open position, by the handle engaged support rods 28, for a loading thereof prior to removal from the rack 24. Accordingly, specific provision is made, in the present invention, for the engagement of the bag handles 16 with the support rods 28.

The engagement of the bag handles is achieved by the provision of rod receiving mounting apertures 34, one through each bag handle 16. The mounting apertures 34 are formed by elongated generally vertical slots or openings extending longitudinally of the bag handles. The vertical slots 34 terminate in bottom and top semicircular curved portions 36 and 38, respectively, which serve to distribute and relieve stresses imposed on the mounting slots. As explained below, the elongated mounting slots make it possible to open the bag mouth to its full desired extent without having a substantial length of bag handle above the top of the mounting slots. Accordingly, the vertical mounting slots preferably have their upper portions disposed near the upper termination of the bag handles 16 with the distance between the top of the upper curved portions 36 and the tops of the bag handles being preferably no more than about the length of the vertical slots.

Flaps 40 formed of handle material as the vertical mounting slots 34 and curved ends 36, 38 are formed by a knife or razor cut, preferably are left in place. They are displaced from the bag pack as the bag pack is inserted on the mounting arms 28 of the rack and help to provide frictional engagement between the mounting arms and the bag pack to keep the bag pack disposed on the rearward portion of the mounting arms as individual bags are pulled forward for opening and use.

As shown in FIGS. 2 through 4, when the bag pack is placed on the mounting rack the parallel supporting arms 28 will be received in the upper curved portions 36 of the mounting apertures or slots 34. As an individual bag is pulled forward on the mounting arms 28, and disposed in a mouth open position for loading, the upper portions 36 of the mounting slots will remain resting on the support rods 28. However, as the bag is opened, the remainder of the slot may be disposed generally longitudinally of the mounting rods 28, as shown in FIGS. 2 and 4, to permit maximum opening of the bag mouth area. This construction makes it possible to shorten the overall length of the handles 16, and thus the overall length of the bags 10, without sacrificing either storage capacity of the bag or the size of the mouth opening during filling operations.

Use of the elongated mounting apertures or slots 34 also makes the bag packs of the present invention more versatile than prior art bag packs. Since the mounting apertures are larger in size than in prior art bags, and extend over a substantial vertical length, they allow one bag construction to be used with various heights and designs of mounting racks. For example, a single bag pack formed in accordance with the present invention may be used on mounting racks with the support arms at varying heights and horizontal spacing, with signal or double support arms and with support arms of various diameters. Bags of varying capacity (e.g., 1/6th or 1/7th barrel capacity bags) also may be used on a single mounting rack having a single pair of support arms. This permits bag packs in accordance with the present invention to be used on a wide variety of bag racks already in place in supermarkets.

A further improved feature of the bag pack in accordance with the present invention involves the central mounting tab 15. It is conventional in prior art bag structures for the central mounting tab to include an aperture engageable with a hook on the bag rack to support the central portion of the bag pack. The tops of all of the mounting tabs conventionally are bonded together to provide a unitary bag pack structure. A horizontal perforated line below the central aperture conventionally is provided so that each bag may be separated from the bonded mounting tabs as it is dispensed. See, for example, U.S. Pat. No. 4,529,090. The portions of the mounting tabs above the perforated line remain on the rack as the bags are used, forming a clump of bonded tab tops which must be removed from the rack before the next bag pack is placed on the rack.

Such prior art structure is improved upon in the present invention by providing curved and generally horizontal elongated central mounting aperture 42, with upwardly facing curved end portions 44, 46, in the lower portion of, or just below, the central mounting tabs 15. The mounting aperture 42 is engageable with the central hook 30 on the bag rack 24. Alternatively, it may be engageable with other hook designs of prior art bag rack structures, as, for example, with the much wider hook element 30 of U.S. Pat. No. Re. 33,264.

A weakened or perforated severance line 48 extends vertically between the center portion of the mounting aperture 42 and the top of the tab 15. As individual bags from the bag pack are pulled forwardly on the support arms 28, the perforated severance line 48 will tear apart, releasing the central tabs 15 from the support hook 30. However, all portions of the mounting tabs 15 remain attached to the bag 12 and are removed with the bag, leaving no portions of the mounting tab on the support rack.

The generally horizontal mounting aperture 42 preferably is formed in a downwardly facing curved configuration, with the central portion of the curve rising toward the top of tab 15 and with the ends 44, 46 curving upward the inward.

The central curved portion helps center the mounting tabs on the hook 30 and also concentrates forces as the bottom of the perforated severance line 48, thus assuring that severance will occur at the perforated severance line 48 rather than elsewhere in the tab area. The upturned end portions 44, 46, of the central mounting aperture 42 reduces force concentrations and avoids accidental downward or side tears of the bag body material.

In order to form the bag packs, a desired quantity of individual bags 12 are disposed in overlapping arrangement and cold pins or the like are inserted through the overlying bags, deforming or swaging the bag material in the immediate vicinity of the pin holes so as to releaseably bond the individual bags together into a unitary pack. The bond thus created is only sufficient to hold the bags together as they are handled and placed on the dispensing racks. The deformed or swaged portions attaching the individual bags to each other are easily separated as the individual bags are dispensed from the racks. Any desired number of such pin hole sites may be provided. In the preferred embodiment, two pin bonding sites 50 are provided in the handle portions, one above each of the mounting apertures 34. Two additional pin bonding sites 52 are provided in the mounting tab 15, one on each side of the perforated line 48.

The pin holes 52 in the central tab 15 also provide a self-opening feature for the bags. As the front wall of the bag is pulled forward to open the bag for filling, the attachment between the front and back portions of the mounting tabs 15 will be severed, but the attachment between the back portion of the tab 15 and the next bag in the bag pack generally will not be severed. As the filled bag then is lifted from the support arms 28, the back portion of the mounting tab 15 will be pulled forward, tending to open the mounting of the next following bag before the connection between the two bags is broken.

The foregoing disclosure and description of the preferred embodiment of the invention is illustative only and various changes may be made in size, shape and materials of construction without departing from the scope of the invention, which is measured solely by the claims.

What is claimed is:

1. In a bag construction of the type comprising front and rear bag walls, a closed bottom, and a top portion, said top portion having a pair of laterally spaced handles, said handles comprising integral extensions of said front and rear bag walls, said front and rear bag walls, between said handles, defining an open bag mouth, each said handle extending above the bag mouth from a lower handle portion defining the lateral extent of said bag mouth to an upper handle portion defining a hand grip, the improvement comprising front and rear central mounting tabs formed integrally with said front and rear bag walls and extending upwardly from the lower portion of said open bag mouth, a central mounting aperture associated with each of said front and rear mounting tabs and adapted for cooperation with a support hook of a rack for mounting said bag and a weakened portion defining a severance line in each of said front and rear mounting tabs extending from said mounting aperture to the top of said mounting tabs, whereby when said bag is mounted on said rack with said support hook of said rack engaging said mounting aperture, said mounting tabs will sever along said severance line as said front and rear bag walls are moved forwardly of said mounting hook, so that said bag may be removed from said bag rack without leaving any portion of said mounting tabs on said hook.

2. The bag according to claim 1 wherein said central mounting aperture comprises an elongated, generally horizontal, opening.

3. The bag according to claim 2 wherein said severance line extends generally vertically from the top center portion of said mounting aperture to the top of said mounting tabs.

4. The bag according to claim 3 wherein said elongated, generally horizontal, opening is formed as a downwardly facing curve to assist in centering said central mounting tabs on said hook and to assist in concentrating severance forces at said generally vertical severance line of said mounting tabs.

5. The bag according to claim 4 wherein said curved, generally horizontal elongated mounting aperture has upturned curved end portions for improved stress relief characteristics.

6. A bag pack mountable on a support rack of the type having a pair of laterally spaced elongated support rods and a central, upwardly facing, support hook disposed between said support rods, said bag pack comprising:

multiple stacked handle bags, each handle bag comprising a pair of laterally spaced upwardly projecting handles receivable on said spaced elongated support rods and a central mounting tab disposed between said spaced upwardly projecting handles for cooperation with said mounting hook of said rack, said multiple stacked bags being positioned with the corresponding handles of the pair of handles and the corresponding central mounting tabs of each bag in stacked aligned overlying relation forming a stack of central mounting tabs and a pair of handle stacks, means releaseably bonding the individual mounting tabs of said stock of mounting tabs to each other, means releaseably bonding the individual handles of said handle stacks to each other, aligned mounting apertures through the handles of each handle stack for simultaneous reception of each handle stack over a corresponding one of said support arms receivable through the aligned apertures, aligned central mounting apertures associate with said aligned mounting tabs for simultaneous reception of each mounting tab in said stack of mounting tabs over said hook of said rack and a weakened portion comprising a severance line extending generally vertically of each of said aligned mounting tabs, from said central mounting apertures to the top of said aligned mounting tabs, whereby when said bag pack is mounted on said rack with said mounting hook through said aligned central mounting apertures, said individual bags may be separated from said bag pack and removed from said mounting rack by severing said mounting tabs along said generally vertically extending severance lines in said mounting tabs and without leaving any portion of said mounting tabs on said hook.

7. The bag pack according to claim 6 wherein said means releaseably bonding the individual mounting tabs of such stack of mounting tabs to each other comprise at least one pin hole extending through said aligned mounting tabs.

8. The bag pack according to claim 7 wherein said bonding means provided by said pin hole extending through said aligned mounting tabs provides a self-opening feature for the bags of said bag pack, whereby when a bag is removed from said bag pack the releasable bond between the mounting tab on the rear wall of the bag being removed and the mounting tab on the front wall of the next bag in the pack will tend to pull the front wall mounting tab and front wall of the next bag forward into a mouth open position.

9. A bag dispensing system comprising a bag pack of multiple stacked handle bags and a rack for mounting said bag pack and loading and individually removing bags from said bag pack;

said rack comprising a pair of laterally spaced elongated support rods having leading ends and a central, upwardly facing, support hook disposed between said support rods;

said bag pack comprising multiple stacked handle bags, each handle bag comprising a pair of laterally spaced upwardly projecting handles receivable on said spaced elongated support rods and a central mounting tab disposed between said spaced upwardly projecting handles for cooperation with said mounting hook of said rack, said multiple stacked bags being positioned with the corresponding handles of the pair of handles and the corresponding central mounting tabs of each bag in stacked aligned overlying relation forming a stack of central mounting tabs and a pair of handle stacks, means releaseably bonding the individual mounting tabs of said stack of mounting tabs to each other, means releaseably bonding the individual handles of said handle stacks to each other, aligned mounting apertures through the handles of each handle stack for simultaneous reception of each handle stack over a corresponding one of said support arms receivable through the aligned apertures, aligned central mounting apertures associated with said aligned mounting tabs for simultaneous reception of each mounting tab in said stack of mounting tabs over said hook of said rack and a weakened portion comprising a severance line extending generally vertically of each of said aligned mounting tabs, from said central mounting apertures to the top of said aligned mounting tabs, whereby when said bag pack is mounted on said rack with said mounting hook through said aligned central mounting apertures, said individual bags may be separated from said bag pack and removed from said mounting rack by severing said mounting tabs along said generally vertically extending severance lines in said mounting tabs and without leaving any portion of said mounting tabs on said hook.

10. The bag according to claim 9 wherein said central mounting aperture comprises an elongated, generally horizontal, opening.

11. The bag acccording to claim 10 wherein said elongated, generally horizontal, opening is formed as a downwardly facing curve to assist in centering said central mounting tabs on said hook and to assist in concentrating severance forces at said generally vertical severance line of said mounting tabs.

12. The bag according to claim 11 wherein said curved, generally horizontal, elongated mounting aperture has upturned curved end portions for improved stress relief characteristics.

13. The bag pack according to claim 9 wherein said means releaseably bonding the individual mounting tabs of such stack of mounting tabs to each other comprise at least one pin hole extending through said aligned mounting tabs.

14. The bag pack according to claim 9 wherein said bonding means provided by said pin hole extending through said aligned mounted tabs provides a self-opening feature for the bags of said bag pack, whereby when a bag is removed from said bag pack the releasable bond between the mounting tab on the rear wall of the bag being removed and the mounting tab on the front wall of the next bag in the pack will tend to pull the front wall mounting tab and front wall of the next bag forward into a mouth open position.

15. In a bag construction of the type comprising front and rear bag walls, a closed bottom, and a top portion, said top portion having a pair of laterally spaced handles, said handles comprising integral extensions of said front and rear bag walls, said front and rear bag walls, between said handles defining an open bag mouth, each said handle extending above the bag mouth from a lower handle portion defining the lateral extent of said bag mouth to an upper handle portion defining a hand grip, the improvement comprising front and rear mounting apertures formed in said front and rear bag walls and adapted for cooperation with a support hook of a rack for mounting said bag and a weakened portion defining a severance line in at least one of said front and rear bag walls extending from said mounting aperture to the top portion of said bag wall defining said bag mouth, whereby when said bag is mounted on said rack with said support hook of said rack engaging said mounting apertures, said bag wall having said severance line will sever along said severance line as said bag wall is moved forwardly of said mounting hook, so that said bag may be removed from said bag rack without leaving any portion of said wall having said severance line on said hook.

16. The bag according to claim 15 wherein said front and rear mounting apertures comprise elongated, generally horizontal, openings.

17. The bag according to claim 15 wherein said severance line extends generally vertically.

18. The bag according to claim 15 wherein said weakened portion defining a severance line is provided in each of said front and rear bag walls.

19. A bag pack mountable on a support rack of the type having a pair of laterally spaced elongated support rods and a central, upwardly facing, support hook disposed between said support rods, said bag pack comprising:

multiple stacked handle bags, each handle bag comprising front and rear bag walls, a pair of laterally spaced handles projecting upwardly from said bag walls and receivable on said elongated spaced support rods, said multiple stacked bags being positioned with the corresponding handles of the pair of handles and the corresponding walls of said front and rear bag walls stacked in aligned overlying relation, forming a stack of bag walls and a pair of handle stacks, means releaseably bonding the individual bag walls of said stack of bag walls to each other, means releaseably bonding the individual handles of said handle stacks to each other, aligned mounting apertures through the handles of each handle stack for simultaneous reception of each handle stack over a corresponding one of said support arms receivable through the aligned apertures, aligned central mounting apertures formed in said front and rear bag walls for simultaneous reception of each bag wall in said stack of bag walls over said hook of said rack and a weakened portion defining a severance line formed in at least one of said front and rear bag walls of each bag and extending from said mounting aperture in said bag wall to the top portion of said bag wall, whereby when said bag pack is mounted on said rack with said mounting hook through said aligned central mounting apertures, said bag wall having said severance line will sever along said severance line as said bag wall is moved forwardly of said mounting hook, so that said bag may be disengaged from said bag pack and removed from said support rack without leaving any portion of said wall having said severance line on said hook.

* * * * *